US007731397B2

(12) United States Patent
Thomas et al.

(10) Patent No.: US 7,731,397 B2
(45) Date of Patent: Jun. 8, 2010

(54) HOUSING FOR SUSPENDABLE ASSEMBLY

(75) Inventors: Robert F. Thomas, Lakeville, MA (US); Jeremy W. Yon, Plympton, MA (US); Michael F. Danahy, Carver, MA (US)

(73) Assignee: Litecontrol Corporation, Hanson, MA (US)

( * ) Notice: Subject to any disclaimer, the term of this patent is extended or adjusted under 35 U.S.C. 154(b) by 229 days.

(21) Appl. No.: 12/154,610

(22) Filed: May 22, 2008

(65) Prior Publication Data

US 2009/0290364 A1 Nov. 26, 2009

(51) Int. Cl.
*F21S 8/06* (2006.01)

(52) U.S. Cl. ..... 362/404; 362/147; 362/219

(58) Field of Classification Search ..... 362/147, 362/219, 404

See application file for complete search history.

(56) References Cited

U.S. PATENT DOCUMENTS 2,625,646 A * 1/1953 Goebel ..... 362/224
5,658,066 A * 8/1997 Hirsch ..... 362/219
6,796,676 B2 * 9/2004 Severtson et al. ..... 362/219
7,380,957 B2 * 6/2008 Lanczy ..... 362/219
2006/0158877 A1 7/2006 Lanczy

* cited by examiner

*Primary Examiner*—Ali Alavi
(74) *Attorney, Agent, or Firm*—David W. Dranchak

(57) ABSTRACT

The invention provides an improvement in suspendable structures and assemblies such as linear lighting fixtures/luminaires that are intended to be suspended from ceilings or other such structures. The housings of the assemblies are designed to include at least one structural member with prestressing in at least along a major longitudinal axis over at least a portion of the length of the member. Once the structural member is incorporated into the housing and overall assembly, the housing and/or assembly is substantially planar and uniform once the assembly is suspended, making the assembly both stronger and more aesthetically appealing. Other embodiments showing extensions to the invention are also disclosed.

20 Claims, 8 Drawing Sheets

HOUSING FOR SUSPENDABLE ASSEMBLY

FIELD OF THE INVENTION

The present invention relates to suspendable structures and assemblies and, more particularly, to lighting fixture/luminaire housings that are intended to be suspended from ceilings or other structures.

BACKGROUND OF THE INVENTION

Suspended structures and assemblies such as linear lighting fixtures (a lighting fixture is also often referred to as a luminaire) are commonly used for the illumination of open spaces due to their ease of installation and their flexibility to be able to be configured to simultaneously provide many different combinations of direct and indirect light in a wide variety of form factors and optional features.

Linear lighting fixtures may be suspended from a ceiling or building support structure using a plurality of suspension means, such as a fixed or adjustable wire cable hangar, a pendant pipe, a chain, or other type of hangar, typically at or near each end of the fixture. Sometimes additional suspension means are added to a fixture, a linear array, or combination of fixtures to prevent sagging or bowing due to gravitational forces, which typically occurs either in the middle of the array or fixture if only an outer pair of suspension points is used, or more generally, at or near the midpoint between the suspension points. It is advantageous to minimize the quantity of suspension means used in such a system, in order to save installation cost and time, and to improve aesthetic appeal. However, sufficient structural support must be present in order to eliminate any sagging of the fixture(s). While structural integrity of the fixture is critical, customers often deem fixtures that sag as a less than attractive look to the lighting system, which diminishes the aesthetic appeal of the lighting system. If the lighting system is not sufficiently structurally supported, and since lighting fixtures can have relatively heavy metal housings which include the light source(s) and electrical components such as ballast systems, an insufficiently supported lighting system can be a safety concern since such a system can potentially fall from the ceiling and a falling fixture is a hazard to people and/or property.

One possible solution to improving the structural integrity of a suspended assembly is by a brute force approach of increasing the thickness of the material used in the walls of the housing of the assembly, but depending on variables such as the overall length of the fixture, this approach may not necessarily achieve the desired results without also increasing the overall dimensions of the assembly. Even if it were successful, this approach is more costly both for materials and shipping, the parts are more difficult to handle in manufacturing, and installation is more difficult.

Another solution to ensuring the structural integrity of a longer assembly such as a lighting fixture is shown in Lanczy, in U.S. Patent Application No. 2006/0158877, which describes a joiner assembly for joining and supporting two linear lighting fixtures together. The joiner assembly includes a joiner bracket including first control surface connected to a second control surface and a draw fastener hole therebetween. The first control surface is configured for controlling a position of the first linear lighting fixture in a prestressed condition, and the second control surface is configured for controlling a position of the second linear lighting fixture in a prestressed condition. A draw fastener is connected to the draw fastener hole. A draw fastener constraint is connected to the draw fastener and configured for connection to at least one of the first linear lighting fixture and the second linear lighting fixture. Due to the visual presence of the break line between fixtures, and the fact that the prestressing is accomplished with linear segments instead of curved or arched ones, this approach makes the break line more pronounced.

It would be highly desirable to have a suspended assembly such as a linear lighting fixture/luminaire that would have the characteristic of preventing sagging or drooping inherent in the assembly itself.

It is therefore an object of the invention to enhance the suspendable assembly art.

It is another object of the invention to incorporate prestressing, at least along a major longitudinal axis, into at least a portion of one of the components in a first structure, such as a luminaire, that is intended to be suspended from a second structure, such as a ceiling to accomplish particular design objectives.

It is still another object of the invention to provide a lighting fixture/luminaire that is both structurally stronger and more aesthetically pleasing.

It is an additional object of the invention to provide a lighting fixture/luminaire with reduced weight, improved manufacturability, lower cost, easier installation, and improved aesthetic appeal.

It is yet another objective of the invention to provide a plurality of lighting fixtures/luminaires, each comprising a structural member with prestressing, that when attached together and the overall structure is suspended, provides the objectives and benefits described hereinabove.

SUMMARY OF THE INVENTION

The present invention provides an improvement in suspendable structures and assemblies such as linear lighting fixtures/luminaires that are intended to be suspended from ceilings or other such structures. The housings of the assemblies are designed to include at least one structural member with prestressing in at least a major longitudinal axis over at least a portion of the length of the member. Once the member is incorporated into the housing and overall assembly, the housing and/or assembly is substantially planar and uniform once the assembly is suspended, making the assembly both stronger and more aesthetically appealing. Other embodiments showing extensions to the invention are also disclosed.

BRIEF DESCRIPTION OF THE DRAWINGS

A complete understanding of the present invention may be obtained by reference to the accompanying drawings, when taken in conjunction with the detailed description thereof and in which.

DETAILED DESCRIPTION OF THE PREFERRED EMBODIMENT

Generally speaking, the present invention provides an improvement in suspendable structures and assemblies such as linear lighting fixtures/luminaires that are intended to be suspended from ceilings or other such structures. The housings of the assemblies are designed to include at least one structural member with prestressing along a major longitudinal axis over at least a portion of the length of the member. Once the structural member is incorporated into the housing and overall assembly, the housing and/or assembly is substantially planar (i.e., flat or level) and uniform once the assembly is suspended, making the assembly both stronger and more aesthetically appealing.

Figure 1:
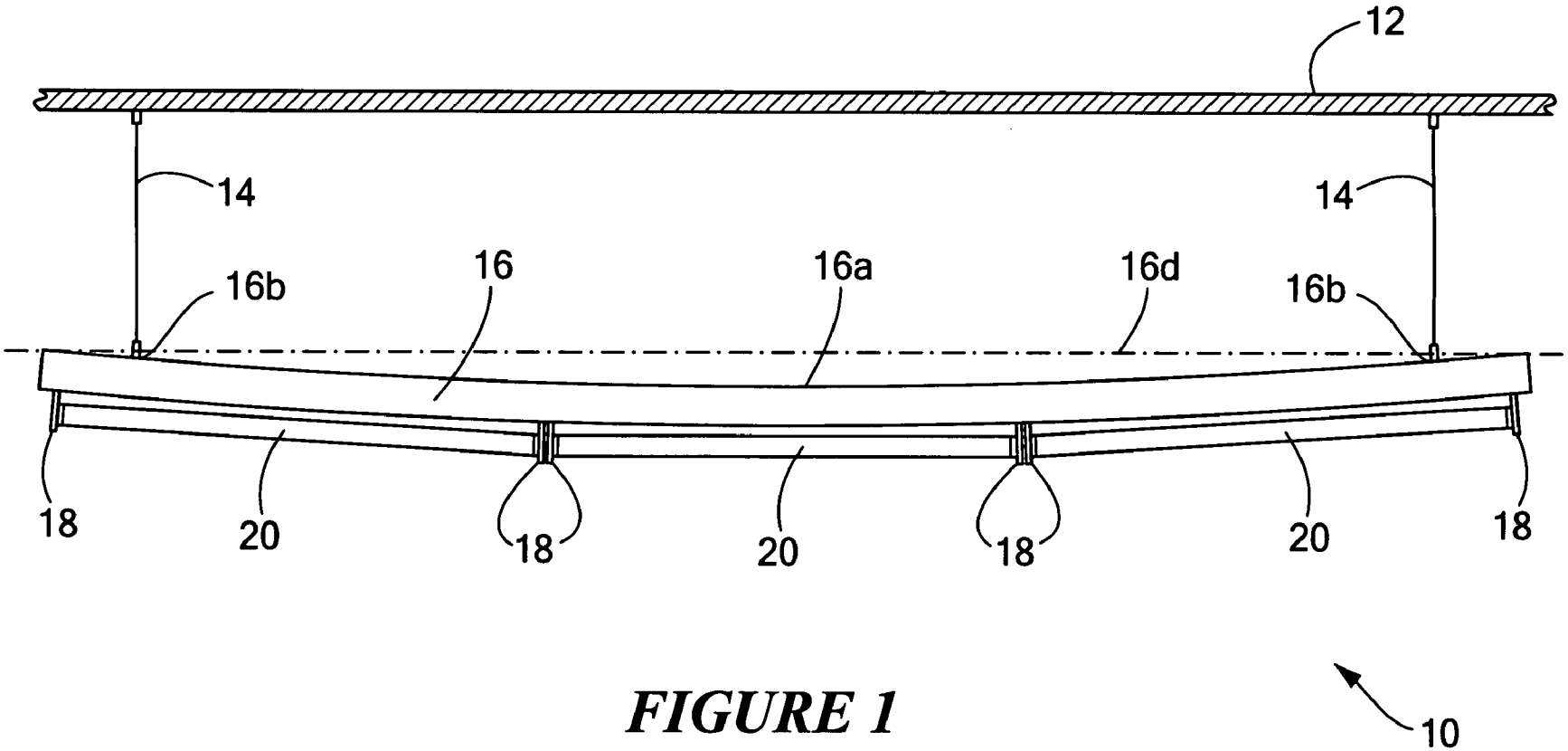
FIGURE 1 PRIOR ART
FIG. 1 is a side view of a suspendable linear luminaire in accordance with the prior art that exhibits the undesirable characteristic of bowing downward or sagging, mostly in the middle of the housing.

Referring first to FIG. 1, there is shown a side view of a typical suspendable linear luminaire 10 of the prior art where a housing 16, that although it is designed to be initially uniform and planar (i.e., flat or level), exhibits the undesirable characteristic, although not necessarily shown to scale, of bowing downward or sagging with the most sagging occurring in the middle 16*a* of the structure, relative to luminaire suspension points 16*b*, each located much closer to the ends of housing 16. Dashed line 16*d* is also included to better show the vertical difference between points 16*a* and 16*b*. Some components typically found in a luminaire, such as a baffle, which is used to guide where the light from the luminaire should or should not go, are intentionally excluded from the drawing for clarity, along with additional mechanical parts, ballasts, power and lamp wires, etc., which are part of a complete luminaire assembly, but are not always easily externally visible.

Housing 16 is made from steel and is suspended from a ceiling 12 by support means 14, which are implemented as fixed length aircraft cables (ACC's) and associated hardware (not shown) and connect to housing 16 at suspension points 16*b*.

Luminaire 10 has three banks of 48-inch long fluorescent lamps 20, making the overall length of luminaire 10 approximately twelve feet. Lamps 20 are held in place and powered through lamp holders 18, which are mechanically connected to housing 16 and electrically connected to one or more ballasts (not shown) typically located within housing 16.

The deficiency in this design of housing 16 can be remedied by adding an additional support means near the point of greatest deflection 16*a* (typically the midpoint between existing support means 14), housing 16 could be redesigned using thicker and/or stronger material, or the size of housing 16 could be increased. It should be obvious to those skilled in the art that these fixes would probably help luminaire 10 to be much more planar and uniform once suspended.

Figure 2:
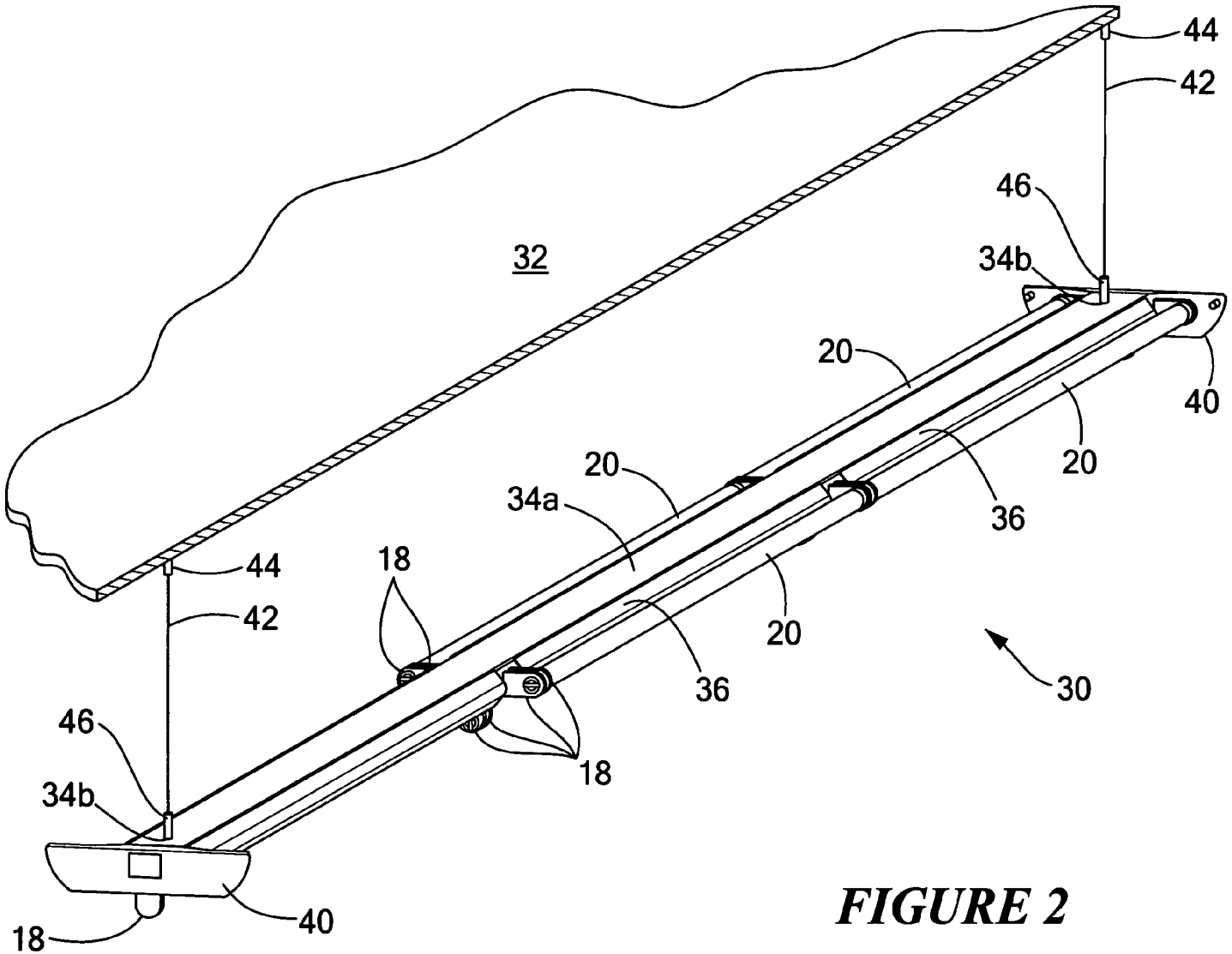
FIG. 2 is a perspective view of a suspendable linear luminaire that includes a prestressed member in accordance with one embodiment of the present invention.
Figure 3:
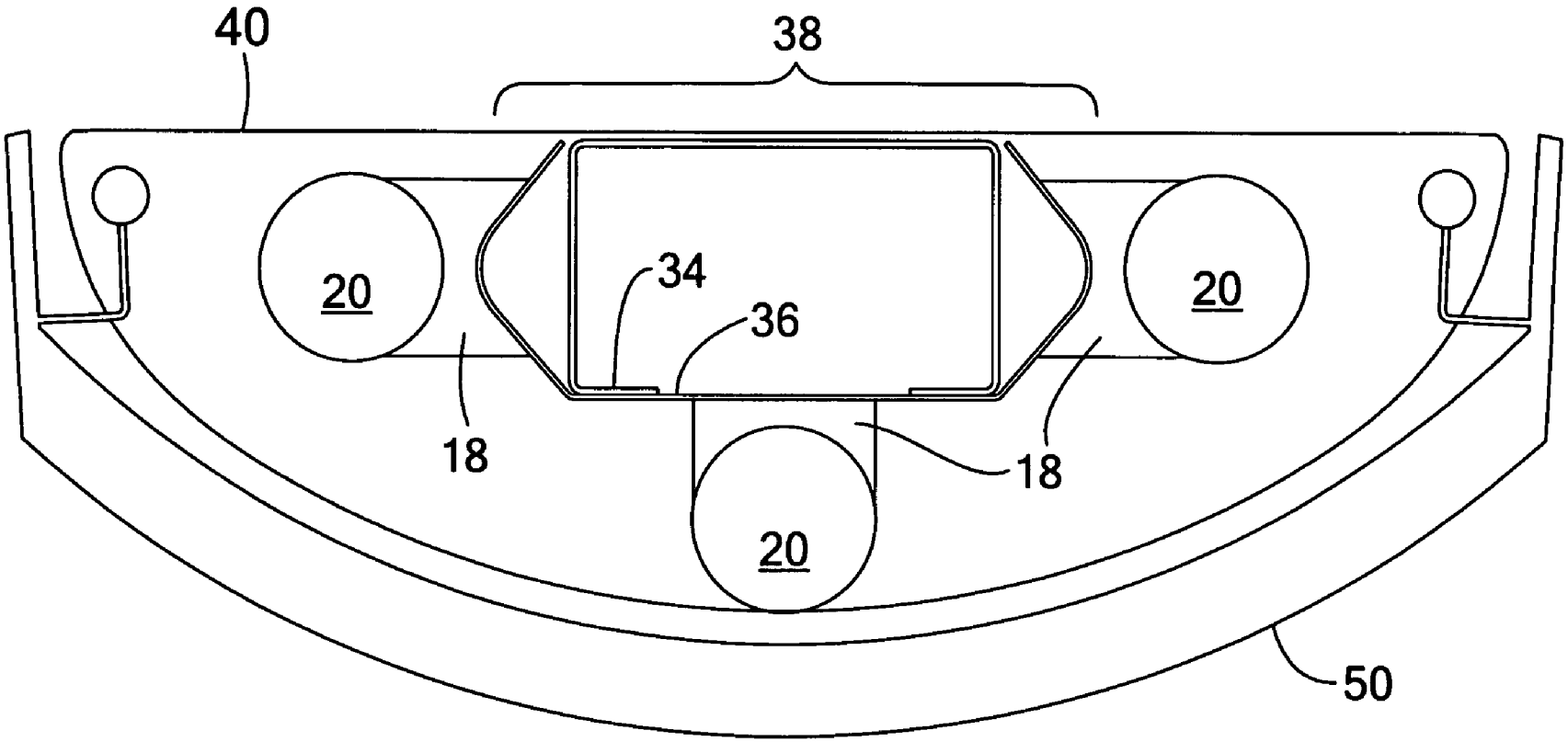
FIG. 3 is a cross sectional end view of the luminaire shown in FIG. 2 but also including a baffle.
Figure 4:
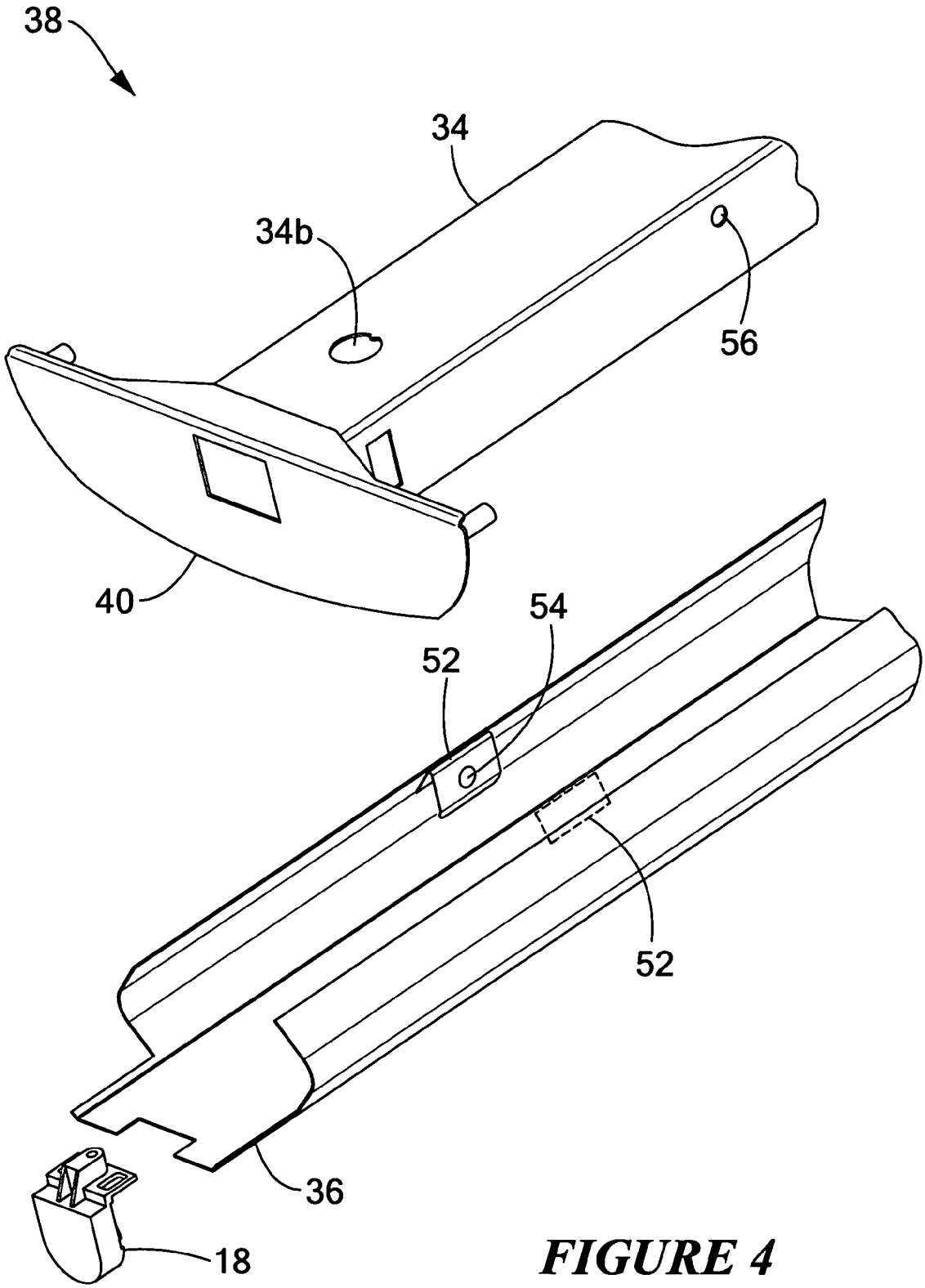
FIG. 4 is an exploded view of some of the components that comprise the luminaire shown in FIGS. 2 and 3.

Referring now to FIGS. 2-6, all in accordance with a first embodiment of the present invention, there is shown a perspective view of a luminaire 30 for suspended mounting to a ceiling 32 or other building support structure, a cross sectional end view of the luminaire shown in FIG. 2 but also including a baffle 50, an exploded perspective view of some of the components that comprise luminaire 30 shown in FIG. 2, a side view of the prestressed member 34 shown in FIGS. 2-4 in a state prior to being installed and suspended; and an end view showing the cross sectional shape of prestressed member 34 shown in FIGS. 2-5.

It should be understood by those skilled in the art that a luminaire assembly may, and typically does have many more components, some optional, some necessary, than those components identified and described in this as well as additional embodiments hereinbelow. For clarity, components such as a baffle 50, which may be optionally included to guide where the light from the fixture should or should not go, may be intentionally excluded from the figures, along with additional mechanical parts, such as brackets, screws and nuts, lamp sockets, ballasts, power and lamp wires, decorative parts, etc., many of which are not always easily externally visible. This is done only to enlighten and not obfuscate the invention. The specific choices, based on material, weight, etc., and locations of these various visible and hidden components probably would affect the design of a particular prestressed member, but this would only affect the details of the amount, type and process of the prestressing included in a specific design point and not whether the inclusion of the invention would be beneficial.

An important aspect of the invention is to incorporate prestressing, in at least in a major longitudinal axis, into at least a portion of one of the components in a first structure, such as a luminaire, that is intended to be suspended from a second structure, such as a ceiling prior to the suspension of the first structure to achieve particular design objectives, such as to have a lighter-weight, suspendable linear lighting fixture/luminaire that is substantially planar and uniform once installed. The prestressing may be applied to a component prior to assembly of the housing and overall luminaire, and it may also occur as a consequence of the assembly process.

In order to clarify a few terms, "loaded state" is used to describe the condition of an assembly, such as a luminaire, once it has been suspended. The term "pre-loaded" describes the condition of an assembly prior to being suspended or "loaded". The term "prestressed state" is used to describe a structural member or housing with prestressing or deformation along at least a portion of the member or housing, or a structural member that is prestressed through the process of assembling the housing.

Luminaire 30 is shown in FIG. 2 in an installed or loaded state, suspended by support means 42 for connection to ceiling 32. Luminaire 30 has both a major longitudinal axis corresponding with the longer dimension of the overall structure, and a latitudinal axis orthogonal to the longitudinal axis, corresponding to the narrower "width", which together define an overall plane for luminaire 30. This plane is preferably perpendicular to the orientation of support means 42, although support means 42 may also intersect the plane at a plurality of other angles.

Support means 42 may be implemented in many ways including as fixed cables, adjustable cables, pendants, and chains, all of which are commonly used in the suspended lighting fixture industry. In this particular embodiment support means 42 is implemented as fixed length aircraft cables (ACC's) with a cable sleeve 44 at the end to be attached to ceiling 32, and a threaded cable stud 46 that passes through suspension points 34*b* in prestressed member 34 and is attached to prestressed member 34 by washers and tightening threaded nuts (not shown). Suspension points 34*b* are implemented in multiple ways including as knockout openings on luminaire 30 in this embodiment to allow other methods of attachment to prestressed member 34. It should be understood that all of the components of support means 42 should be made of materials and dimensions that safely support luminaire 30 and meet all required safety codes and regulations, such as Underwriters Laboratories Inc. (UL) and the National Electrical Code (NEC). In fact, it is understood that many of the components of luminaire 30 must also meet these standards.

Referring now to FIGS. 2 and 3, in this embodiment luminaire 30 includes locations for three banks of a group of fluorescent lamps 20, with each group consisting of one lamp 20 on either side of housing 38 and one lamp 20 centered and below the lower surface of housing 38. Some lamps 20 are not included in the figures to allow other components to be more visible. The three banks of 48-inch long fluorescent lamps 20 make the overall length of luminaire 30 approximately twelve feet. Lamps 20 are held in place and powered through lamp holders 18, which are mechanically connected to prestressed member 34 and electrically connected to a ballast (not shown) typically located within housing 38. It should be understood that other lamp types (i.e., T5 or T2 fluorescent lamps), lengths and quantities, as well as other light sources including but not limited to arrays of light emitting diodes (LED's) with appropriate power supplies, or powered strips of electroluminescent material may be used in luminaire 30.

Although this embodiment uses three reflectors 36, one for each bank of fluorescent lamps 20, reflectors 36 for this luminaire 30 could have been formed as a single unit.

Referring now to FIGS. 3 and 4, prestressed member 34, reflector 36, and end header assembly 40 work together as components of housing 38 of luminaire 30 and the cross sectional shape that they form in this embodiment might be described as a rectangle with rounded triangular sides. Housing 38 performs many mechanical and electrical functions including: mechanically supporting lamp holders 18, which provide electrical connection both to fluorescent lamps 20 and through lamp wires (not shown) to a ballast (not shown) within housing 38; providing location(s) to connect to support means 42; providing support for baffle 50, and providing a connection to AC power and potentially to a sensor and/or control system (not shown). Many features of housing 38 are implemented to meet code compliance. Although a baffle 50 is included in this embodiment, other components such as a diffuser or a lens could have been used instead. Those skilled in the art will appreciate the differences among these components and whether one is even necessary for a given application.

Prestressed member 34 is typically made from 16-22 gauge (GA) steel while reflector 36 and end header assembly 40 are typically made from 18-24 gauge steel. The specific thicknesses used are application dependent. Other materials that could have been used for these components include aluminum, beryllium, copper, and plastic, although the thicknesses would most likely change. Experiments were performed to make a part similar in size and shape to prestressed member 34, but without the prestressing. Even when 14 gauge steel was used, which bordered on the limits of practicality from a manufacturing standpoint, the part still exhibited some sagging.

End header assembly 40 provides several functions including enclosing an end of housing 38, providing supports to attach baffle 50 to, and to allow internal access to an adjoining luminaire (not shown) through knockouts (not shown) if so desired.

Reflectors 36 cover and help to protect the various components located within housing 38. While reflector 36 is shown with rounded sides which help to improve reflectivity and therefore the optical efficiency, this invention does not require these kinds of improvements. The reflector could be a much simpler structure that would make the shape of the housing a rectangle. In fact, while the present embodiment shows prestressed member 34 and reflectors 36 as each being one piece, it should be understood by those skilled in the art that each component may consist of more than one piece, and that housing 38 could consist of many more components than shown in this embodiment, or even be integrated into a single overall housing component with prestressing.

Reflector 36 is held in contact with prestressed member 34 by reflector spring clips 52, each including a bump 54 that mates with respective reflector clip mounting holes 56 in prestressed member 34. Clips 52 attach to reflector 36 and have enough tension to hold reflector 36 onto prestressed member 34 in its prestressed shape. Once luminaire 30 is suspended, the installer pushes reflectors 36 up until bumps 54 on clips 52 are seated in holes 56 in prestressed member 34. Alternatively, one could use mechanical fasteners as long as each properly aligned with mating slots, etc. to accommodate the shape or curve of prestressed member 34.

Although suspension points **34*b* (FIGS. 2 and 4) are located on prestressed member 34 in this embodiment, they could be located on reflector 36 or another component of luminaire 30 instead. It is also possible that the prestressing could be incorporated into reflector 36 instead of prestressed member 34**, or into a combination of both of them, thereby reducing the amount of prestressing or deformation needed on any one component.

Figure 5:
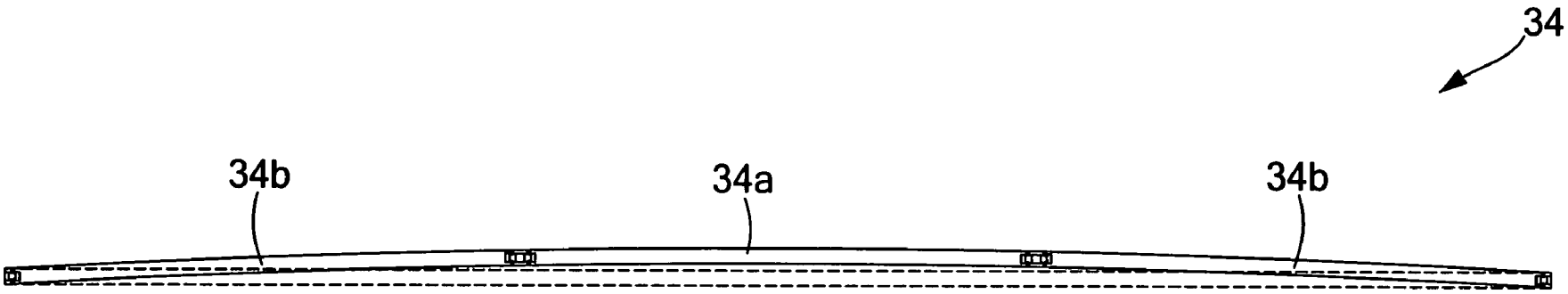
FIG. 5 is a side view of the prestressed member shown in FIGS. 2-4 shown in a state prior to being incorporated into the luminaire and suspended.

Prestressed member 34 is shown in FIG. 5 prior to installation within luminaire 30 or suspended from ceiling 32 (FIG. 2). In this embodiment, prestressed member 34 is generally arched or bowed in the middle section **34*a* relative to luminaire suspension points 34*b*, each located much closer to the ends of member 34. In this embodiment, middle section 34*a* is typically prestressed or deformed up to two inches compared to the ends of prestressed member 34 for a member 34** of this length. It should be obvious to those skilled in the art that the specific amount of deformation or prestressing is dependent on many design factors such as materials used, material thickness, length, component weight and placement, and that the actual amount of prestressing required could even be beyond the typical range.

After prestressed member 34 is incorporated into housing 38, along with all of the other necessary and optional components that are part of the overall luminaire 30, and support means 42 are connected to prestressed member 34 toward the outer edges at suspension points **34*b* and suspended from ceiling 32, due to the weight and position of the various components that comprise luminaire 30 and gravitational forces, the shape of prestressed member 34 will change to one with less deformation, and therefore housing 38 and/or the overall luminaire 30 will be substantially planar and uniform, thereby counteracting and offsetting the gravitational forces. It should be understood that support means 42 could be attached to luminaire 30 in other ways than through the top surface of prestressed member 34. For example, support means 42 could wrap around or through one or more of the components of housing 38** to accomplish an equivalent function.

Applying prestressing to prestressed member 34 may be accomplished in several different ways. A first method is to use cable tensioning to create the prestressing in prestressed member 34. An analogy of this method is an archery bow, where a cable other than the support means 42 cables is used to keep member 34 in a prestressed state once it has been initially shaped. This method tends to keep the prestressing continuous between the two points of the contact for the tensioning cable. A second method is to apply a force to member 34, then remove the force. Depending on the specific implementation, in this method the member 34 may or may not be plastically deformed. An analogy of this method would be how a wood worker would use a bending jig to bend or form a piece of wood. One difference would be where the wood worker might use water to help bend the wood, a metal worker might use heat to bend or form the metal. How continuous the prestressing is would be influenced by factors such as the continuity of the jig (versus a jig with pegs that might be more of a piecewise approximation) and the particular source and method of applying heat. A third method is rollforming, a continuous bending operation in which a sheet or coil of metal is passed through consecutive sets of rolls or stands, each performing only an incremental part of the bend, until the desired cross-section profile for member 34 is obtained. A fourth method is forming a part through a metal extruding process. Once the metal is heated to a point so that it may pass through a die of appropriate shape, various techniques may be used to create the required shape of the part.

Alternatively, a structural component may acquire a prestressed shape as part of the assembly process. For example, if a first component of a housing had an arched shape even if it was not caused by prestressing, and a component similar to member 34 but without prestressing was screwed down or fastened to the first component in a manner that followed the shape or contour of the first component, the first component could enable the second component to be prestressed functionally similar to member 34. Those skilled in the art will appreciate how the five methods described hereinabove as well as others not mentioned have their advantages and disadvantages depending on the particular task needed to be accomplished.

It should be appreciated that under real world conditions and tolerances, housing 38 and/or luminaire 30 would be completely planar and uniform once suspended only under a very limited set of circumstances. Therefore, it is preferred that if prestressed member 34 cannot be exactly planar when installed, that it maintain a slightly prestressed shape instead of dipping or sagging in the middle. This is both for the aesthetic reasons previously described but also because this shape is mechanically stronger. The 'strength' of the crown results from prestressed member 34 resisting being flattened by the added load. In contrast, in a downward sagged luminaire (the undesirable condition), there is no benefit because the loading is in the same direction as the crown so there is no resistance to the extra load. So for the abovementioned reasons, since luminaire 30 is suspended at two points, it is preferred that the greatest amount of bowing or arching in prestressed member 34 occurs near the middle area 34*a* between these those points.

As an extension to using this prestressing concept for a suspendable structure, instead of a component having the prestressing implemented as a single arch radiating from a central position, it is possible that the prestressed member could have more than one bow or arch. Think in terms of a sine wave of very low amplitude, where the suspension points would be two locations (preferably symmetric from the center of the luminaire) that are or at least near points on the prestressed member further away from the ceiling, etc. This could significantly reduce the maximum amount of prestressing or deformation needed.

Prestressed member 34 may also be prestressed in a latitudinal axis perpendicular to the longitudinal axis, or in a combination of the two as well. This may be useful for an application where the structure is wider, such as a square for example. For the case of a square prestressed member or fixture, it may be desirable that suspension points be located nearer to the corners rather than to the points centered in the latitudinal axis as shown in the present embodiment.

The design of a suspended structure may incorporate additional functional or aesthetic features as an extension of the invention as long as the design includes at least one prestressed portion or section near or between the suspension point(s), so that at least one of the structural members provides for a mechanically stronger structure. For example, in a luminaire with two suspension points, aesthetics may call for the portions of the luminaire housing outside of the suspension points to be shaped upward or downward, while the portion of the housing between the suspension points is carried out as shown in the embodiment of FIGS. 2-6, including a single centered arched or bowed section.

If two luminaires 30 (FIGS. 2-6) of the present invention are joined end-to-end, an additional support means 42 would most likely be required between the luminaires 30 to properly support the assemblies. But using a variation of the prestressing concept employed in the embodiments disclosed hereinabove, a luminaire could be designed so that the prestressing is applied asymmetrically to a structural member of the luminaire, so that the maximum prestressing or deformation occurs at or near one end of the member instead of near the middle, and the minimum prestressing or deformation occurs at or near the opposite end of the member. In this case, when a luminaire with an asymmetrically prestressed member is joined end-to-end with a second luminaire of the same design that is rotated 180 degrees compared to the first luminaire, it should be understood that the two luminaires can be joined so that the overall combined shape is bowed or arched similar to a single prestressed member 34 in luminaire 30 (FIGS. 2-6) prior to installation. Once the overall structure of luminaires is suspended from the suspension points, each located toward the outer edge of each luminaire, the overall structure would be substantially planar and uniform once installed.

Figure 6:
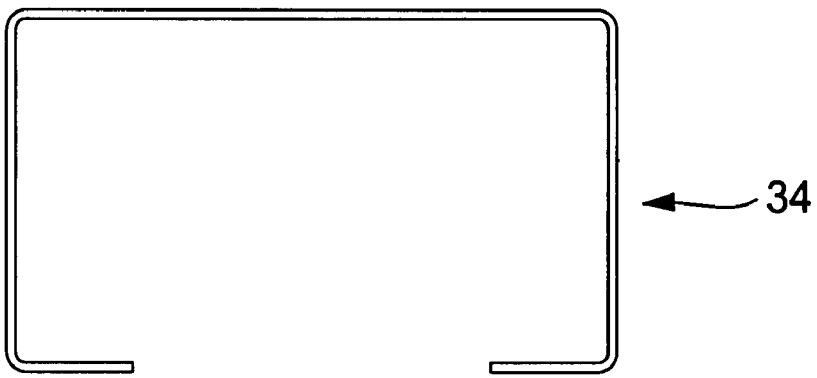
FIG. 6 is an end view showing the cross sectional shape of the prestressed member shown in FIGS. 2-5.
Figure 7:
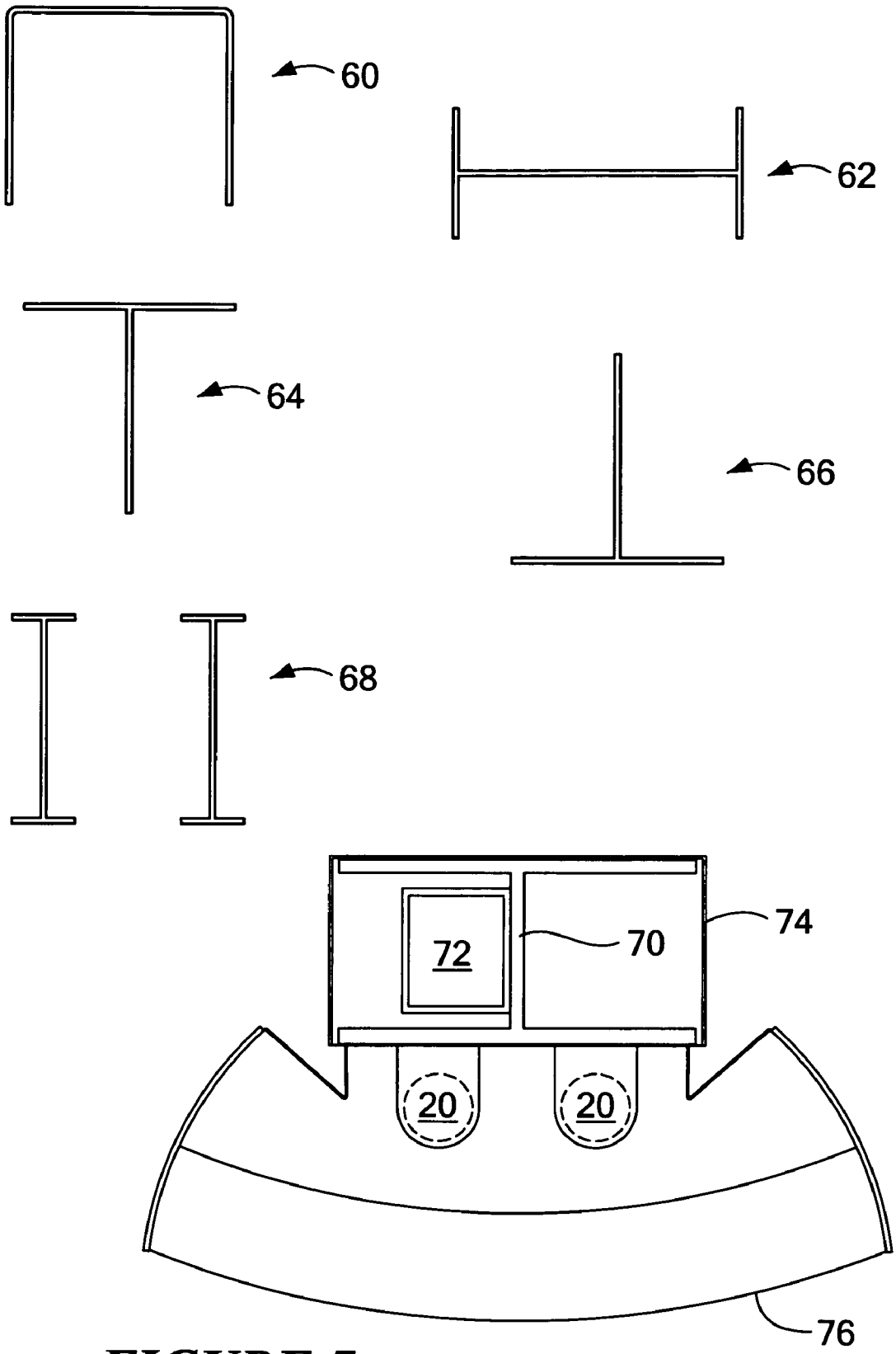
FIG. 7 is a view of several possible alternative cross sectional shapes for a prestressed member in accordance with an extension of the embodiment of FIGS. 2-6.

Referring now to FIG. 6, there is shown the cross sectional shape of prestressed member 34. The shape of a component that functions similar to prestressed member 34 may have many different shapes as long as the shape and quantity of the other components that comprise a housing are adjusted accordingly so that they collectively provide functionality similar to housing 38 (FIGS. 2-4). Some possible alternative prestressed shapes are shown in FIG. 7. Example include a U-shaped member 60, an H-shaped horizontal I-beam 62, a T-shaped member 64, an inverted T-shaped member 66, a pair of I-beams 68, and a single I-beam 70 shown with a pair of lamps 20, a ballast 72 mounted on the side of I-beam 70, a housing cover 74, and a baffle 76 that clips onto I-beam 70.

It is possible that the housing could even be a single component or part, still with prestressing, that has a cross section closed on all four sides which would be very strong. Openings for components such as lamp holders and ballasts could be cut into the housing as needed.

Figure 8:
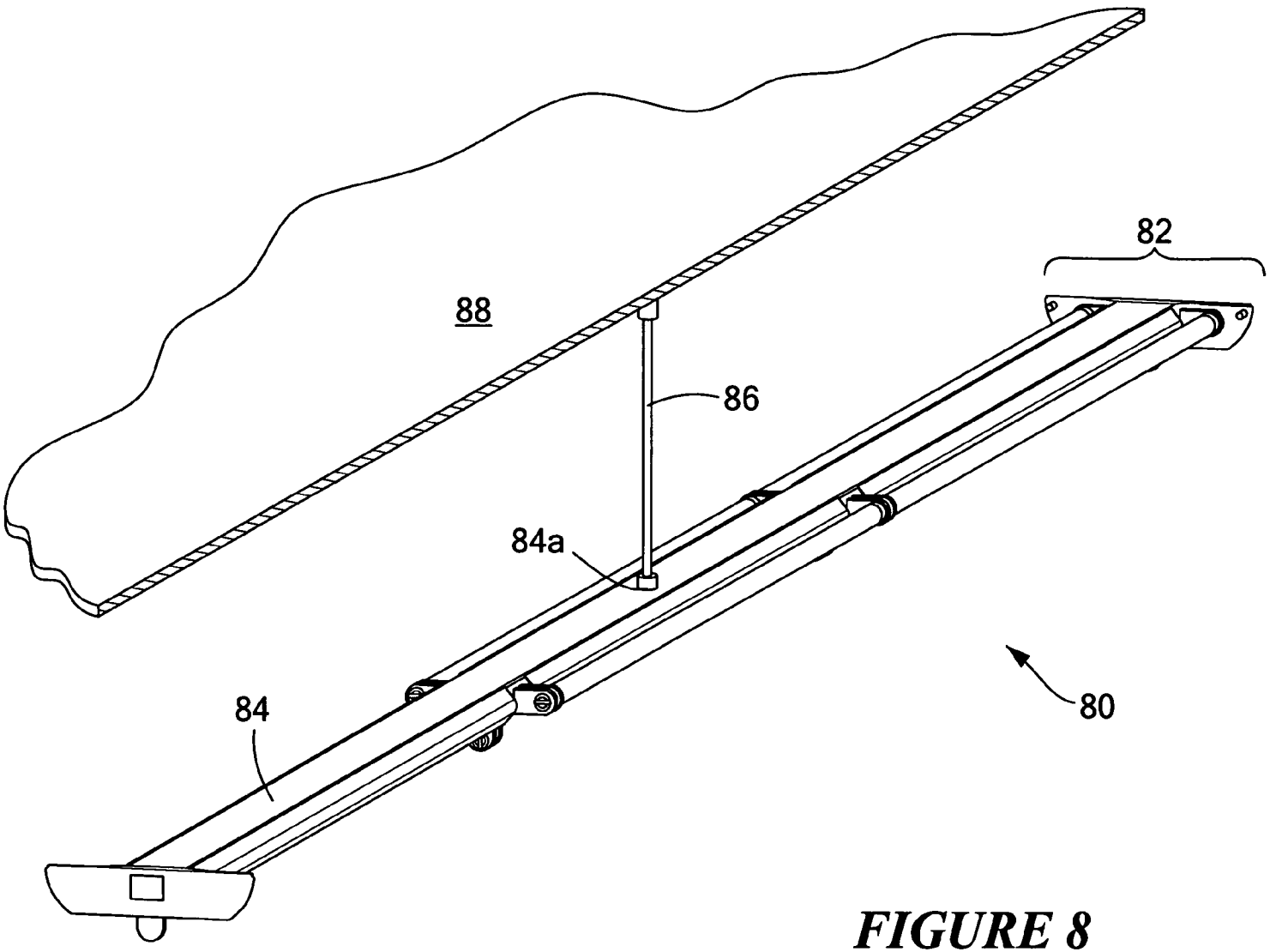
FIG. 8 is a perspective view of a suspendable linear luminaire that includes a prestressed member in accordance with another embodiment of the present invention.
Figure 9:
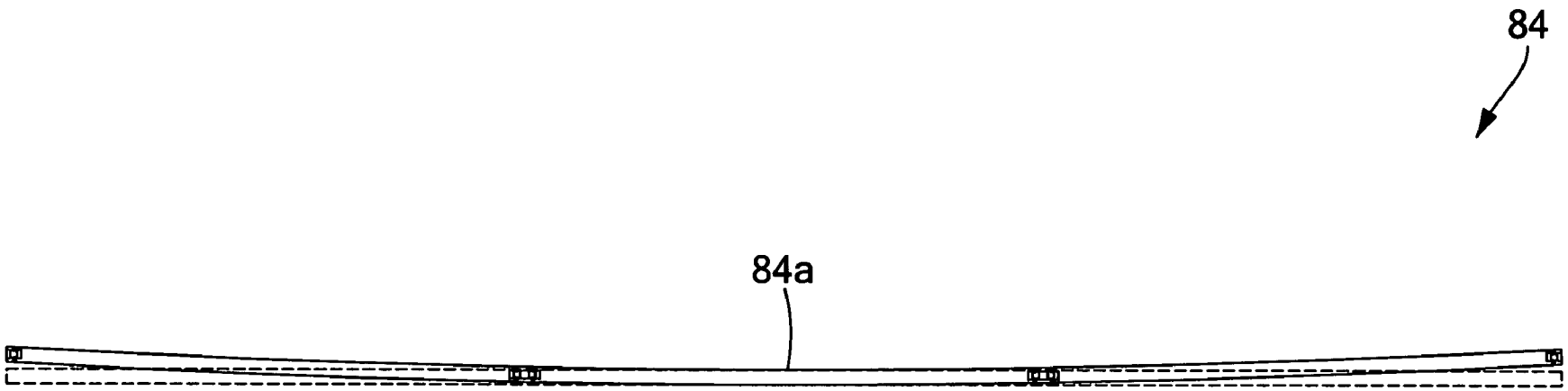
FIG. 9 is a side view of the prestressed member of the luminaire of FIG. 8 shown in a state prior to being incorporated into the luminaire and suspended.

Referring now to FIGS. 8 and 9, there is shown a luminaire 80, that is an extension of the invention shown in FIGS. 2-6. Luminaire 80 requires only a single suspension means 86 to support a housing 82 with a prestressed member 84 that includes bowing or arching in the opposite direction of prestressed member 34 (FIGS. 2-6) while still allowing housing 82 and therefore the overall luminaire 80 to be primarily planar or uniform once suspended. In this embodiment, suspension means 86 is implemented as a pendant pipe of a particular length because the pendant can be securely attached to both luminaire 80 and to a ceiling 88 such that luminaire 80 can be oriented in a given position during installation and will remain in that position unless it is determined that luminaire 80 should be rotated or otherwise moved to a different position.

Since luminaire 80 connects to suspension means 86 at suspension point 84*a*, which is located further away from ceiling 88 when luminaire 80 is in an uninstalled state, prestressed member 84 (see FIG. 9) has a bowed or arched shape that in this case is substantially the inverse of the prestressed shape of prestressed member 34 (FIGS. 2-6). That is, where the outer edges of member 84 in its uninstalled state are raised compared to suspension point 84*a*.

Since other modifications and changes varied to fit particular operating requirements and environments will be apparent to those skilled in the art, this invention is not considered limited to the representative examples chosen for purposes of this disclosure, and covers all changes and modifications which do not constitute departures from the true spirit and scope of this invention.

Having thus described the invention, what is desired to be protected by Letters Patent is presented in the subsequently appended claims.

What is claimed is:

1. A suspendable assembly comprising:

a) a luminaire having a first axis and a second orthogonal axis, said first and second axes defining a plane;

b) at least one suspension point disposed proximate thereto; and c) a prestressed structural member for maintaining said plane substantially planar when said luminaire is suspended from said at least one suspension point.

2. The suspendable assembly as recited in claim 1, wherein said first axis is an elongated axis, and wherein at least a portion of said prestressed structural member is prestressed in at least said first axis.

3. The suspendable assembly as recited in claim 2, wherein said at least a portion of said prestressed structural member is chosen from the group: arched, bowed and curved, prior to suspending said luminaire.

4. The suspendable assembly as recited in claim 1, wherein said prestressed structural member is chosen from the group: prestressed prior to incorporation within said suspendable assembly, and prestressed by incorporation to said prestressed assembly.

5. A method of maintaining a suspendable luminaire substantially parallel to a reference plane external thereto, the steps comprising:

a) providing a luminaire having a first axis and an orthogonal second axis defining a plane, and comprising a prestressed component exerting an offsetting force upon said luminaire, said offsetting force being substantially equal to and opposite to a gravitational force acting on said luminaire in said plane; and b) suspending said luminaire from at least one suspension point disposed on said luminaire;

wherein said plane is maintained substantially parallel to said external reference plane.

6. A housing for a suspendable assembly comprising a structural member, at least a portion of said structural member having a first prestressed shape when said housing is in a pre-loaded state, and a second prestressed shape when said housing is in a loaded state.

7. The housing as recited in claim 6, wherein said at least a portion of said structural member has a first deformation at a point thereon when said housing is in said pre-loaded state, and said at least a portion of said structural member has a second deformation at said point when said housing is in said loaded state.

8. The housing as recite in claim 7, wherein said first deformation is greater than said second deformation.

9. The housing as recited in claim 6, wherein after said housing is incorporated into a suspendable assembly comprising at least one suspension point, and said suspendable assembly is suspended therefrom, said housing is substantially planar.

10. The housing as recited in claim 9, wherein said suspendable assembly is chosen from the group: luminaire and lighting fixture.

11. The housing as recited in claim 6, wherein said structural member is chosen from the group: prestressed prior to incorporation within said housing, and prestressed by incorporation to said housing.

12. The housing as recited in claim 6, wherein said first prestressed shape is chosen from the group: arched, bowed and curved; and said second prestressed shape is chosen from the group: arched, bowed, curved, and substantially planar.

13. The housing as recited in claim 6, wherein the material comprising said structural member is chosen from the group: steel, aluminum, beryllium, copper, and plastic.

14. A suspendable assembly comprising:

a) a housing further comprising a structural member having prestressing along at least a portion thereof in at least a first axis; and b) at least one suspension point;

wherein after said suspendable assembly is suspended from said at least one suspension point, at least one chosen from the group: said housing and said suspendable assembly, is substantially planar.

15. The suspendable assembly as recited in claim 14, wherein said first axis is a major longitudinal axis.

16. The suspendable assembly as recited in claim 14, wherein said structural member has prestressing along at least a portion of said structural member along a second axis.

17. The suspendable assembly as recited in claim 14, wherein said suspendable assembly is chosen from the group: a luminaire and a lighting fixture.

18. The suspendable assembly as recited in claim 17, further comprising means for generating light.

19. The suspendable assembly as recited in claim 14, wherein said housing comprises a plurality of housings, each comprising a respective prestressed structural member.

20. The suspendable assembly as recited in claim 19, wherein at least two of said plurality of housings are joined together in at least one axis.

* * * * *